United States Patent [19]

Hijikata et al.

[11] 3,933,194

[45] Jan. 20, 1976

[54] PATTERN PLATE DEVICE FOR VACUUM SEALED MOLDING

[75] Inventors: Itsuo Hijikata, Nagoya; Hideto Terada; Kazuo Nagasaka, both of Toyokawa, all of Japan

[73] Assignee: Sintokogio, Ltd., Aichi, Japan

[22] Filed: July 26, 1974

[21] Appl. No.: 492,333

[30] Foreign Application Priority Data

Apr. 5, 1974 Japan ..... 49-39298

[52] U.S. Cl. ..... 164/160; 164/239

[51] Int. Cl.[2] ..... B22C 15/22

[58] Field of Search ..... 425/388; 164/7, 160, 237, 164/239, 240, 241, 242, 243

[56] References Cited

UNITED STATES PATENTS 3,843,301 10/1974 Hijikata et al. ..... 164/160 X

FOREIGN PATENTS OR APPLICATIONS 592,741 2/1960 Canada ..... 164/241

*Primary Examiner*—Francis S. Husar
*Assistant Examiner*—John E. Roethel
*Attorney, Agent, or Firm*—Armstrong, Nikaido & Wegner

[57] ABSTRACT

A pattern plate device for vacuum sealed molding, being applied with a negative pressure to the surfaces of said device, covered with a flexible film on said surfaces tightly, on which a molding flask having a reducing structure is set, and then being used for performing a vacuum sealed molding operation.

8 Claims, 11 Drawing Figures

PATTERN PLATE DEVICE FOR VACUUM SEALED MOLDING

BACKGROUND OF THE INVENTION

In the vacuum sealed molding process, a molding flask is fitted onto a pattern plate device to the surfaces of which a flexible film is being sucked to be in tight contact therewith. Then, the molding flask is filled with a particulate material and the upper opening of the molding flask is covered with a flexible film. Subsequently, the particulate material is hardened by the application of a negative pressure to the interior of the molding flask, and the pattern plate device is drawn apart from the molding flask. FIG. 11 shows a pattern plate device conventionally used when carrying out the above operation. In this pattern plate device, a pattern 2 is formed on a box-shaped pattern plate 1 integrally therewith, and in the pattern plate 1 there is provided a reduced pressure chamber 3 which can be connected to a vacuum pump (not shown). The interior of said reduced pressure chamber 3 is placed in communication with the surfaces of the pattern 2 by means of small-diameter holes 4, so that a sucking action is provided on the surfaces of the pattern 2 and a flexible film is sucked and placed in tight contact with said surfaces. In this pattern plate device having the above construction, it is needed to form the pattern plate 1, the pattern 2, and the reduced pressure chamber 3 as an integral unit, resulting in an increased manufacturing cost. In addition, a large amount of work and a high degree of skill are required when boring a multiplicity of the small-diameter holes 4 about 1 mm. in diameter at necessary positions on the pattern 2 including the corners thereof. These problems constitute serious disadvantages.

SUMMARY OF THE INVENTION

The present invention has been completed to solve the problems described above.

An object of the present invention is to provide a pattern plate device in which a pattern plate is detachably attached to said pattern plate device so that various pattern plates can be used with said pattern plate device by changing said various pattern plates one after another.

Another object of the present invention is to provide a pattern plate device in which a pattern can be readily attached to and removed from a pattern plate to which the pattern is attached.

Still another object of the present invention is to provide a pattern plate device in which sucking structures at the corners of a pattern can be manufactured readily.

A further object of the present invention is to provide a pattern plate device in which a flexible film can be surely placed in tight contact with the surfaces of a pattern at the corners of said pattern.

A further object of the present invention is to provide a pattern plate device in which a flexible film sucked and placed in tight contact with the surfaces of a pattern can be prevented from peeling off from said surfaces.

These objects and features of the present invention will become more clear by the following description of preferred embodiments taking reference with the attached drawings, in which.

Hereunder an explanation will be given on the details of the present invention with reference to the embodiments shown in FIGS. 1 through 7.

Figure 1:
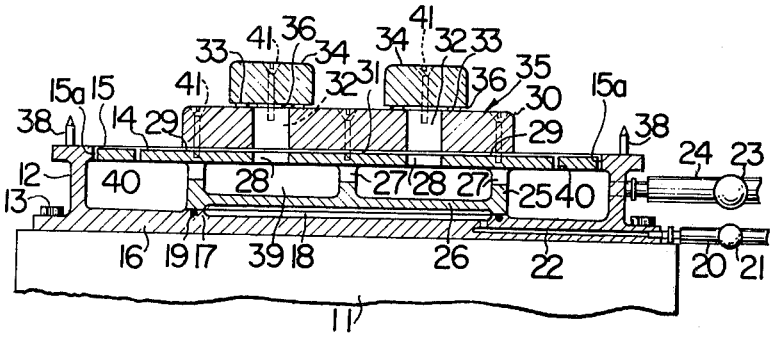
FIG. 1 is a sectional front view showing a first embodiment of the present invention.
Figure 2:
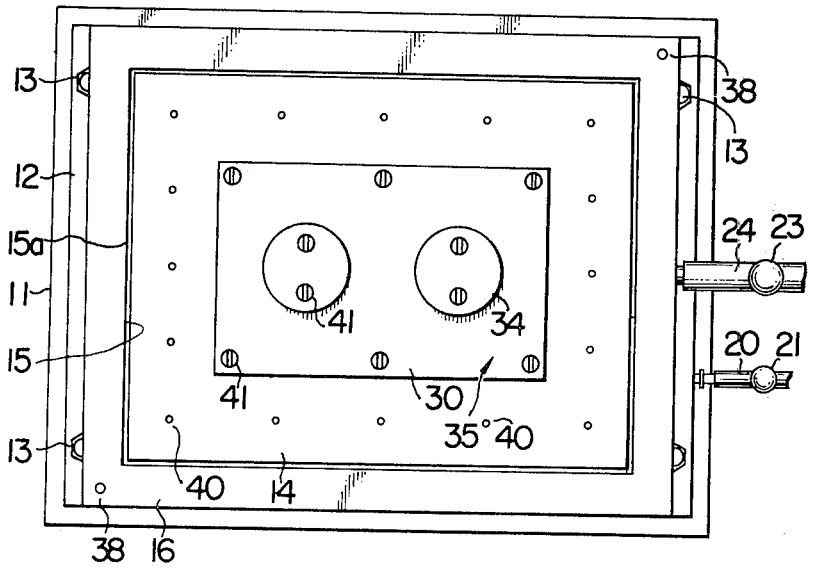
FIG. 2 is a plan view illustrating the embodiment of FIG. 1.

Referring to FIG. 1 illustrating a first embodiment of the present invention, a fitting bed 12 which is in the shape of a shallow box and securely fixed on a table 11 by means of bolts 13, has a box frame portion 16 with an upper opening 15 onto which a pattern plate 14 can be fitted with a minor amount of space 15*a* being formed therebetween. A recess 18 is formed by an encircling projection 17 in the central part of the bottom of the box frame portion 16. A sealing member 19 such as an O-ring is embedded in the upper surface of the encircling projection 17. To the recess 18 is connected an inner air passage 22 communicating with a vacuum pump (not shown) through a hose 20 and a change-over valve 21. On one side of the box frame portion 16 a suction pipe 24 pierces into said box frame portion 16 and communicates with a vacuum pump (not shown) through a change-over valve 23. The pattern plate 14 fitted onto the upper opening 15 has on the lower surface thereof an encircling rib 25 in contact with the encircling projection 17. A partition plate 26 is disposed inside the rib 25 to cover the recess 18 and form a sealed chamber. A suitable number of through holes 27 are provided at suitable positions on the rib 25, so that the sucking action of the suction pipe 24 is applied to all area of the lower surface of the pattern plate 14. The pattern plate 14 has air vents 28 extending vertically through said pattern plate 14. A pattern body 30 is attached to the upper surface of the pattern plate 14 through washers 29 with a space 31 being formed between the pattern body 30 and the pattern plate 14. The space 31 is in communication with air vents 28. The pattern body 30 is provided with air vents 32 corresponding to the air vents 28 and extending vertically through said pattern body 30. Sub pattern bodies 34 are attached to the upper surface of the pattern body 30 through washers 33 at positions just above the air vents 32 to form a given pattern 35 together with the pattern body 30. Spaces 36 are formed between the sub pattern bodies 34 and the pattern body 30. The washers 29 have a thickness of about 0.5–1.0 mm. and are placed at suitable positions under the pattern body 30 which is fixed securely on the pattern plate 14 by suitable fastening means such as bolts 41.

The sub pattern bodies 34 may be fixed securely on the pattern body 30 by means of the bolts 41 and the like in the same manner as the pattern body 30 securely fixed to the pattern plate 14 using the bolts 41.

Figure 3:
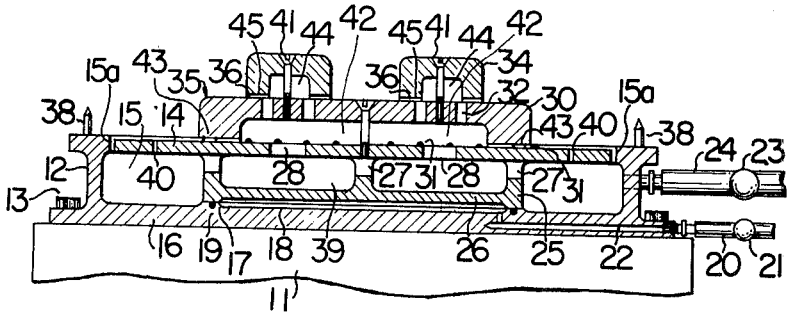
FIG. 3 is a sectional front view showing a second embodiment of the present invention.
Figure 4:
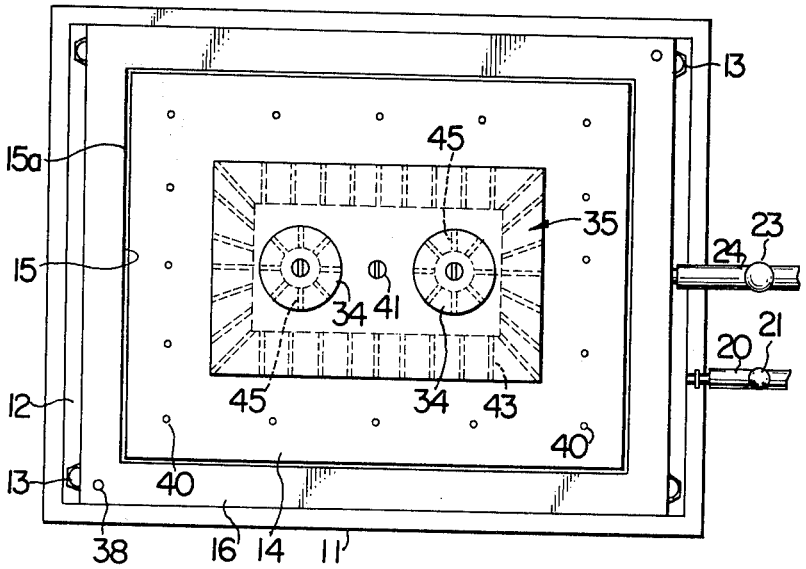
FIG. 4 is a plan view illustrating the embodiment of FIG. 3.

Turning to FIG. 3 showing a second embodiment of the present invention, a concave air chamber 42 is formed on the lower surface of a pattern body 30 and communicates with air vents 28. Also on the lower surface of the pattern body 30 there are arranged a suitable number of vent grooves 43 extending radially to communicate with said air chamber 42, so that spaces 31 are formed between a pattern plate 14 and the lower surface of the peripheral portion of the pattern body 30. In the same manner as described above, sub pattern bodies 34 respectively have air chambers 44 and vent grooves 45, and spaces 36 are formed between the sub pattern bodies 34 and the pattern body 30. In the embodiments illustrated in FIGS. 1 and 3, the pattern plate 14 is fitted onto the upper opening 15 of the fitting bed 12 with a minor amount of space 15*a* being formed between the peripheral edge of the pattern plate 14 and the peripheral edge of the upper opening 15, so that an encircling groove is formed along the periphery of the pattern plate 14.

Figure 5:
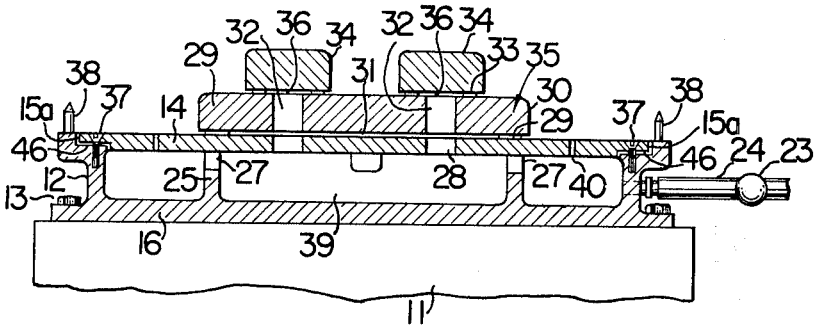
FIG. 5 is a sectional front view showing a third embodiment of the present invention.
Figure 6:
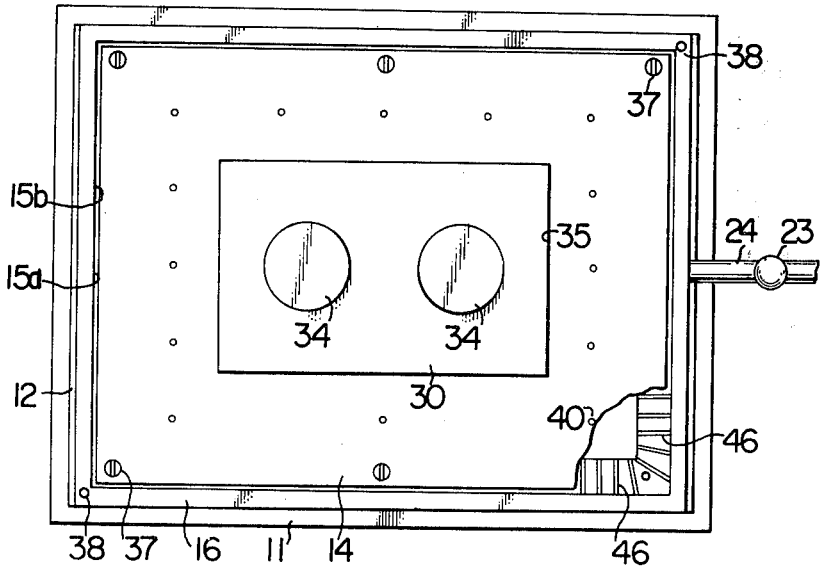
FIG. 6 is a partly broken away plan view showing the embodiment of FIG. 5.
Figure 7:
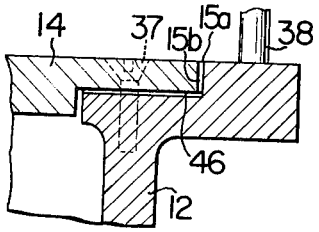
FIG. 7 is an enlarged view illustrating the important part of the embodiment of FIG. 5.

Referring to FIG. 5 showing a third embodiment of the present invention, a fitting bed 12 is identical with the fitting bed 12 of the embodiment illustrated in FIG. 1 except that the inner air passage 22 and the recess 18 are removed, and that the rib 25 and the through holes 27 are formed integrally with the fitting bed 12. A pattern plate 14 is attached to a stepped opening 15*b* of the fitting bed 12 by means of bolts 37. In this embodiment, a space 15*a* formed between the fitting bed 12 and the pattern plate 14 does not extend vertically the full thickness of the pattern plate 14. For this reason, as illustrated in FIG. 7, vent grooves 46 may be arranged on the stepped fitting portions of the fitting bed 12 to which the peripheral edge of the pattern plate 14 is fitted, so that a film can be sucked and placed in tight contact with the surface of the periphery of the pattern plate 14. The vent grooves 46 may alternatively be disposed on the stepped fitting portions of the pattern plate 14. In the figures, the numerals 38 through 40 respectively indicate guide pins, a hollow chamber, and small-diameter holes.

In the first and second embodiments of the present invention, if the change-over valve 21 is operated to place the hose 20 in communication with the vacuum pump (not shown) after the pattern plate 14 has been fitted to the fitting bed 12 as shown in FIGS. 1 and 3, the pressure in the sealed chamber defined by the recess 18 of the fitting bed 12 and the partition plate 26 of the pattern plate 14 is reduced, so that the pattern plate 14 is brought into tight contact with the fitting bed 12 by vacuum suction. Then, the change-over valve 23 is operated to reduce the pressure in a hollow chamber 39 definned by the box frame portion 16 of the fitting bed 12 and the pattern plate 14. With this operation, a sucking action is applied through the air vents 28 and the space 31 or through the air chamber 42 and the vent grooves 43 to the lower surfaces of the pattern body 30 and the sub pattern bodies 34. The sucking action is also applied to the space 15*a* between the fitting bed 12 and the pattern plate 14. At this point, the surface of the pattern plate 14 is covered with a flexible film for forming vacuum sealed molds, so that the flexible film is sucked and placed in tight contact with the surface of the pattern plate 14. The flexible film is sucked to the spaces 31 and 36 under the lower surfaces of the pattern body 30 and the sub pattern bodies 34 and to the vent grooves 43 and 45, with the result that the flexible film is brought into tight contact with the surfaces of the pattern 35 consisting of the pattern body 30 and the sub pattern bodies 34 and is formed to the shape of said surfaces of the pattern 35. The flexible film is sucked to the space 15*a* and come into tight contact with the periphery of the pattern plate 14. After this point of operation, conventional vacuum sealed molding steps are followed for producing a finished mold. When forming a mold with another shape, the change-over valve is operated to terminate the pressure reducing action applied to the sealed chamber, and the sealed chamber is placed in communication with the outside atmosphere. Then, the pattern plate 14 is removed from the fitting bed 12 and another pattern plate 14 is attached to the fitting bed 12. Thereafter, the sequence of operations described above is repeated.

In the third embodiment of the present invention, the change-over valve 23 is operated for producing a sucking action to draw the flexible film when the whole pattern plate device is in a state shown in FIG. 5. In this case, the space 15*a* is not extending vertically the full thickness of the pattern plate 14, however, the flexible film can be drawn to the upper surface of the pattern plate 14 by the sucking action of the space 15*a* if the vent grooves 46 are provided in the stepped fitting portions of either the pattern plate 14 or the fitting bed 12 as described previously. The pattern plate 14 can be changed with another pattern plate by removing the bolts 37.

Figure 8:
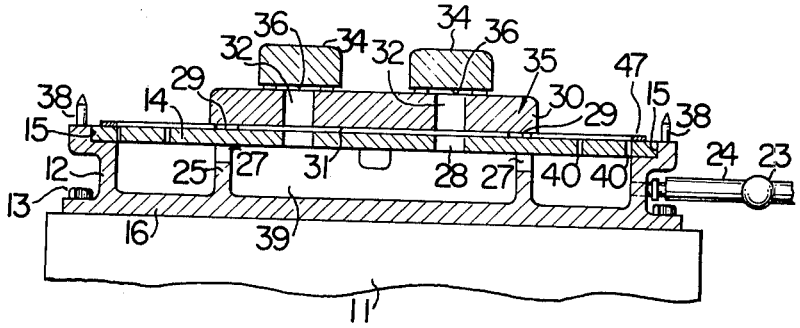
FIG. 8 is a sectional front view illustrating a fourth embodiment of the present invention.
Figure 9:
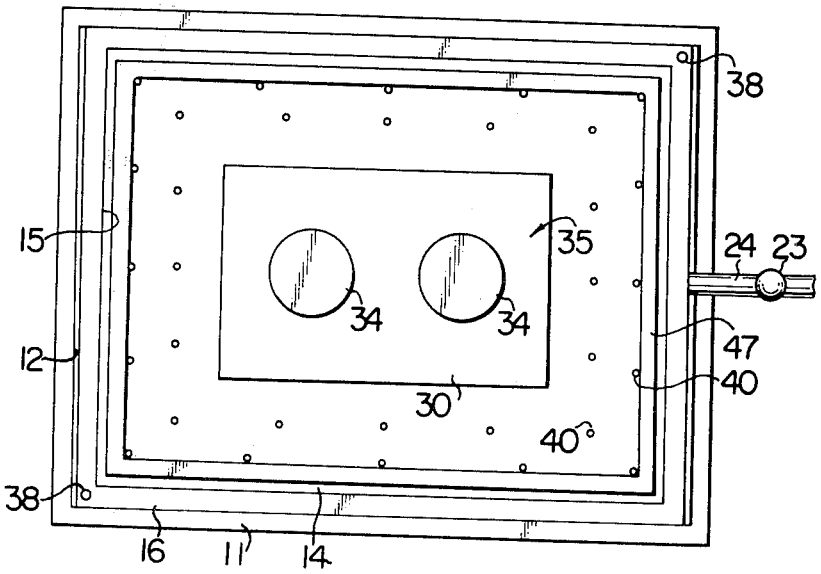
FIG. 9 is a plan view showing the embodiment of FIG. 8.
Figure 10:
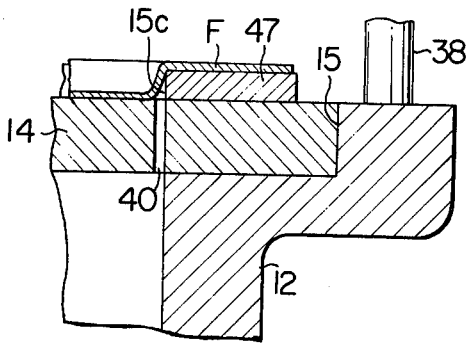
FIG. 10 is an enlarged view illustrating the important part of the embodiment of FIG. 8.
Figure 11:
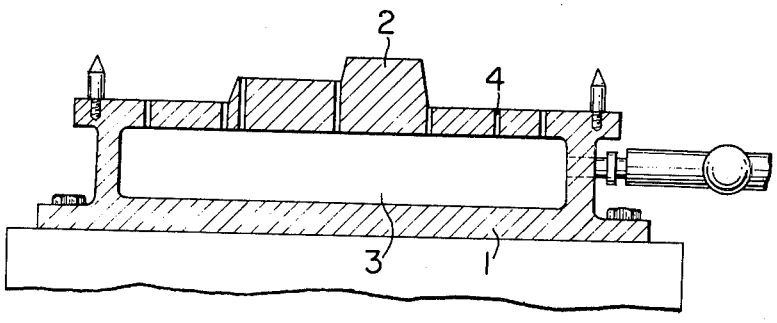
FIG.11 PRIOR ART
FIG. 11 is a sectional front view showing a conventional pattern plate device for vacuum sealed molding.

FIGS. 8 through 10 show a fourth embodiment of the present invention. In this fourth embodiment, the relationship between a pattern body 30 and a pattern plate 14 is identical with that in the third embodiment while a different method is employed in sucking the flexible film to the upper surface of the pattern plate 14. An encircling bank 47 with a small thickness is disposed on the upper surface of the pattern plate 14 along the peripheral edge of said upper surface. The encircling bank 47 may be either formed integrally with the pattern plate 14 or produced separately and thereafter mounted on the pattern plate 14. Small-diameter holes 40 are arranged all over the pattern plate 14 as in the third embodiment and are additionally provided along the inner edges of said encircling bank 47 at given intervals. As illustrated in FIG. 10, when the pattern plate 14 is covered with the flexible film F, the flexible film F is not placed in tight contact with the surface portions along the peripheral edge of the pattern plate 14 where the upper surface of the pattern plate 14 comes into contact at right angles with the vertical surfaces of the inner edge of the encircling bank 47. An encircling tubular space 15*c* defined by the flexible film F, the upper surface of the pattern plate 14, and the vertical surfaces of the inner edge of the encircling bank 47, is thus formed on said surface portions along the inner edges of the encircling bank 47. This space 15*c* is utilized to produce a sucking action. Since the space 15*c* is in communication with a hollow chamber 39 thanks to the small-diameter holes 40, a sucking action is applied through the space 15*c* to the flexible film F, so that the flexible film F is placed in tight contact with the peripheral edge of the pattern plate 14. Thus, the flexible film F is surely brought into tight contact with the upper surface of the pattern plate 14.

Said encircling bank 47 can be provided on the pattern plate 14 or the fitting bed 12 of the pattern plate device illustrated in FIG. 1 through FIG. 6.

In the present invention, as has been explained in the foregoing with reference to the embodiments thereof, the pattern plate 14 is so constructed that it can be separated from the fitting bed 12, and thanks to this feature a large number of different pattern plates 14 can be readily used with the same fitting bed 12 by changing the pattern plate 14 one after another. Needless to say, this leads to a greatly reduced manufacturing cost. The pattern 35 consisting of the pattern body 30 and the sub pattern bodies 34 is attached to the upper surface of the pattern plate 14 using the washers 29 and 33 or with the vent grooves 43 and 45 extending on the lower surfaces of the pattern body 30 and the sub pattern bodies 34, so that the spaces 31 and 36 are formed. With these constructions, a sucking action to be applied to the flexible film can be readily provided at the lower surfaces of the pattern body 30 and the sub pattern bodies 34. Further, the pattern plate 14 is supported at the lower surface thereof by the rib 25 having the through holes 27 and is fitted onto the upper opening 15 of the fitting bed 12. This construction boasts a high degree of stability. The pattern plate 14 may be attached to and removed from the fitting bed 12 by starting and stopping the application of a reduced pressure to the sealed chamber defined by the inner air passage 22 leading to the vacuum pump, the recess 18, and the partition plate 26. In this case, the attachement and removal of the pattern plate 14 can be carried out more readily and surely. Since the pattern plate 14 is fitted onto the upper opening 15 of the fitting bed 12 with a minor amount of the space 15*a* being formed between the upper opening 15 and the pattern plate 14, the flexible film can be sucked in a very sure manner, so that the flexible film never peels off from the peripheral edge of the pattern plate 14. Thus, the present invention enjoys various advantages as described above and can serve the industry by bringing about a great deal of benefit.

We claim:

1. A pattern plate device for forming vacuum sealed molds in which a flexible film is sucked to the surfaces of said pattern plate device and placed in tight contact therewith comprising a frame body having a bottom plate and an encircling side wall to form an opening above the bottom plate, a pattern plate adapted to be detachably attached to said frame body, to cover said opening and to define a hollow chamber inside said encircling side wall, said pattern plate being provided with first communicating means along the periphery of said pattern plate for communicating the upper surface of the pattern plate with said hollow chamber and at least one through hole for communicating the upper surface of the pattern plate with said hollow chamber, a pattern provided on the upper surface of said pattern plate, and pressure reducing means disposed in said frame body and adapted to render a reduced pressure to said hollow chamber for producing a sucking action in said first communicating means, so that said flexible film is sucked and placed in tight contact with the upper surface of the pattern plate along the periphery thereof, said pattern including second communicating means, forming spaces between the lower surface of said pattern and the upper surface of said pattern plate, said second communicating means adapted to communicate with at least one of said through holes and to form open ends at positions along the peripheral edge of the lower surface of said pattern, so that said flexible film is adapted to be sucked and placed in tight contact with the peripheral edge of the lower surface of said pattern by said reduced pressure.

2. A pattern plate device for forming vacuum sealed molds in accordance with claim 1 in which said pattern is attached to the upper surface of said pattern plate through washers.

3. A pattern plate device for forming vacuum sealed molds in which a flexible film is sucked to the surfaces of said pattern plate device and placed in tight contact therewith comprising a frame body having a bottom plate and an encircling side wall to form an opening above the bottom plate, a pattern plate adapted to be detachably attached to said frame body, to cover said opening and to define a hollow chamber inside said encircling side wall, said pattern plate being provided with first communicating means along the periphery of said pattern plate for communicating the upper surface of the pattern plate with said hollow chamber and at least one through hole for communicating the upper surface of the pattern plate with said hollow chamber, a pattern provided on the upper surface of said pattern plate, and pressure reducing means disposed in said frame body and adapted to render a reduced pressure to said hollow chamber for producing a sucking action in said first communicating means so that said flexible film is sucked and placed in tight contact with the upper surface of the pattern plate along the periphery thereof, said pattern consisting of second communicating means adapted to communicate with at least one of said through holes and to form open ends at positions along the peripheral edge of the lower surface of said pattern, so that said flexible film is adapted to be sucked and placed in tight contact with the peripheral edge of the lower surface of said pattern by said reduced pressure.

4. A pattern plate device for forming vacuum sealed molds in accordance with claim 3 in which there is provided on the lower surface of said pattern an air chamber having an opening in communication with at least one of said through holes, and said plurality of grooves are in communication with said air chamber and extend radially from said air chamber to the peripheral edge of the lower surface of said pattern.

5. A pattern plate device for forming vacuum sealed molds in which a flexible film is sucked to the surfaces of said pattern plate device and placed in tight contact therewith comprising a frame body having a bottom plate and an encircling side wall to form an opening above the bottom plate, a pattern plate adapted to be detachably attached to said frame body, to cover said opening and to define a hollow chamber inside said encircling side wall, said pattern plate being provided with first communicating means along the periphery of said pattern plate for communicating the upper surface of the pattern plate with said hollow chamber, a pattern provided on the upper surface of said pattern plate, and pressure reducing means disposed in said frame body and adapted to render a reduced pressure to said hollow chamber for producing a sucking action in said first communicating means, so that said flexible film is sucked and placed in tight contact with the upper surface of the pattern plate along the periphery thereof, wherein said frame body has on said bottom plate an encircled projecting wall to form another opening above said bottom plate, said projecting wall having a sealing member thereon, said pattern plate has on the lower surface thereof covering means adapted to cover the another opening formed by said projecting wall, so that a sealed hollow chamber is defined inside said encircled projecting wall, and said frame body includes second pressure reducing means adapted to render a reduced pressure to said sealed hollow chamber, so that said pattern plate is sucked and attached to said frame body.

6. A pattern plate device for forming vacuum sealed molds in accordance with claim 5 in which the periphery of said pattern plate is in a shape that permits said pattern plate to fit onto the opening of said frame body for being attached thereto, and a space in communication with said hollow chamber is adapted to be formed between the periphery of said pattern plate and the encircling side wall, so that said flexible film is adapted to be sucked and placed in tight contact with the surface portions along said periphery of said pattern plate by said reduced pressure.

7. A pattern plate device for forming vacuum sealed molds in accordance with claim 5 in which said pattern plate is provided on the upper surface thereof with an encircling bank located along and outside said first communicating means.

8. A pattern plate device for forming vacuum sealed molds in accordance with claim 5 in which said encircling side wall is provided on the upper portion thereof with an encircling bank located along and outside said first communicating means.

* * * * *